US006976877B2

(12) United States Patent
Lien

(10) Patent No.: US 6,976,877 B2
(45) Date of Patent: Dec. 20, 2005

(54) MULTILAYER ELECTRIC CONNECTOR

(76) Inventor: Teh Sou Lien, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/739,722

(22) Filed: Dec. 17, 2003

(65) Prior Publication Data

US 2004/0132342 A1 Jul. 8, 2004

(30) Foreign Application Priority Data

Dec. 25, 2002 (TW) ..... 91221067 U

(51) Int. Cl.[7] ..... H01R 13/26
(52) U.S. Cl. ..... 439/620; 439/676
(58) Field of Search ..... 439/620, 676

(56) References Cited

U.S. PATENT DOCUMENTS 6,068,520 A * 5/2000 Winings et al. ..... 439/676
6,227,905 B1 * 5/2001 Tsai et al. ..... 439/541.5
6,511,348 B1 * 1/2003 Wojtacki et al. ..... 439/620
6,773,302 B2 * 8/2004 Gutierrez et al. ..... 439/620
6,786,772 B1 * 9/2004 Liu ..... 439/620

FOREIGN PATENT DOCUMENTS

TW 483606 4/2002
TW 510604 11/2002

* cited by examiner

*Primary Examiner*—Tho D. Ta
*Assistant Examiner*—James R. Harvey

(57) ABSTRACT

A multilayer electric connector comprises a main board having at least two layers of slots, each upper slot and lower slot sandwiched by two-lateral circuit boards. Two conductive sets electrically connect the upper slot, lower slot and those two circuit boards. The upper conductive set has two conductive members, one of which connects the main board via the upper slot and the right circuit board, the other of which connects the right circuit board and an external instrument terminal. The lower conductive set connects the lower slot and the left circuit board in a symmetric configuration as the upper conductive set connects the upper slot and the right circuit board. The circuit boards, coupled with the conductive sets, form two receptacles therebetween.

3 Claims, 4 Drawing Sheets

MULTILAYER ELECTRIC CONNECTOR

FIELD OF INVENTION

The present invention relates to multilayer electric connectors, more particularly to a multilayer electric connector in which conductive components are assembled in three-dimensional configuration, thereby producing a larger space for housing electronic elements for enhancing signal quality by filtering or converting mechanisms.

DESCRIPTION OF THE PRIOR ART

The twenty-first century is an age of telecommunication when communication hardware is becoming more and more complex, which requires better quality of signal transmission. The present electric connectors for signal transmission are RJ type connectors. To increase instrument capacity that can be supported by an electric connectors multilayer electric connectors such as the one disclosed by R.O.C. Pat. No. 483606 is introduced to mate a plurality of input/output terminals. This invention is disadvantageous in a lack of a filtering mechanism for reducing high-frequency noises induced in the connector. Later on, another multilayer electric connector disclosed by R.O.C. Pat. No. 510604 has housing space for a filtering module, but the space does not suffice to allow more flexible circuit layouts and more effective heat radiation. Therefore, the signal-filtering devices therein do not last long.

SUMMARY OF THE PRESENT INVENTION

Accordingly, the present invention is to provide a multilayer electric connector having sufficient room for housing filtering electronic elements and for effective heat radiation. A multilayer electric connector therefore designed comprises a main board having at least two layers of slots, each upper slot and lower slot sandwiched by two lateral circuit boards. Two conductive sets electrically connect the upper slot, lower slot and those two circuit boards. The upper conductive set has two conductive members, one of which connects the main board via the upper slot and the right circuit board, the other of which connects the right circuit board and an external instrument terminal. The lower conductive set connects the lower slot and the left circuit board in a symmetric configuration as the upper conductive set connects the upper slot and the right circuit board. The circuit boards, coupled with the conductive sets, form two receptacles therebetween. Thereby, sufficient room is produced between two layers of slots for housing electronic elements that enhance signal quality by filtering or converting mechanisms.

The various objects and advantages of the present invention will be more readily understood from the following detailed description of preferred embodiments, when read in conjunction with the appended drawings.

DESCRIPTION OF THE PREFERRED EMBODIMENTS

Figure 1:
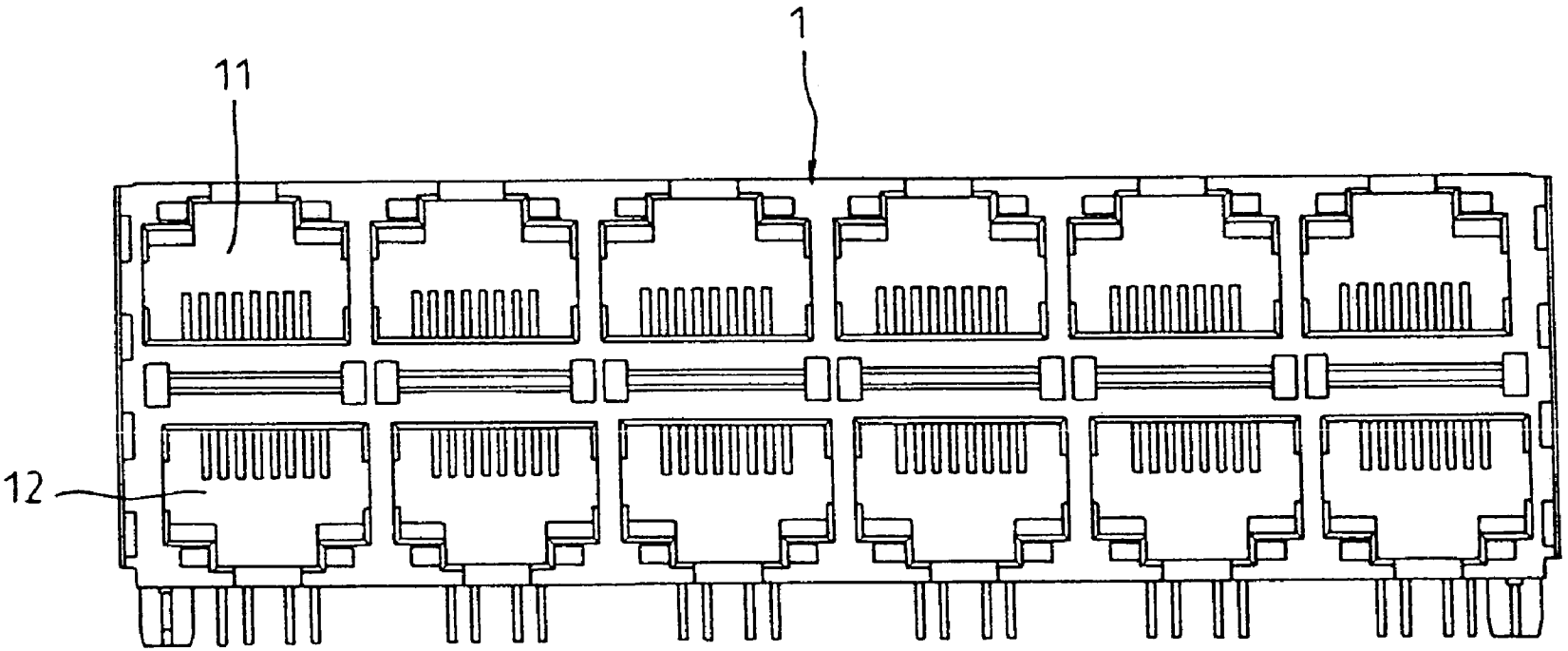
FIG. 1 is a front view of a multilayer electric connector according to the present invention.

As shown in FIG. 1, a preferred embodiment of the present invention as a multilayer electric connector comprises a main board 1 that has a plurality of slots (11, 12, for example). To save space, those slots are arranged in an interlaced fashion into different layers so that external connectors can be inserted or pulled out easily; in this the preferred embodiment, there are two layers.

Figure 2:
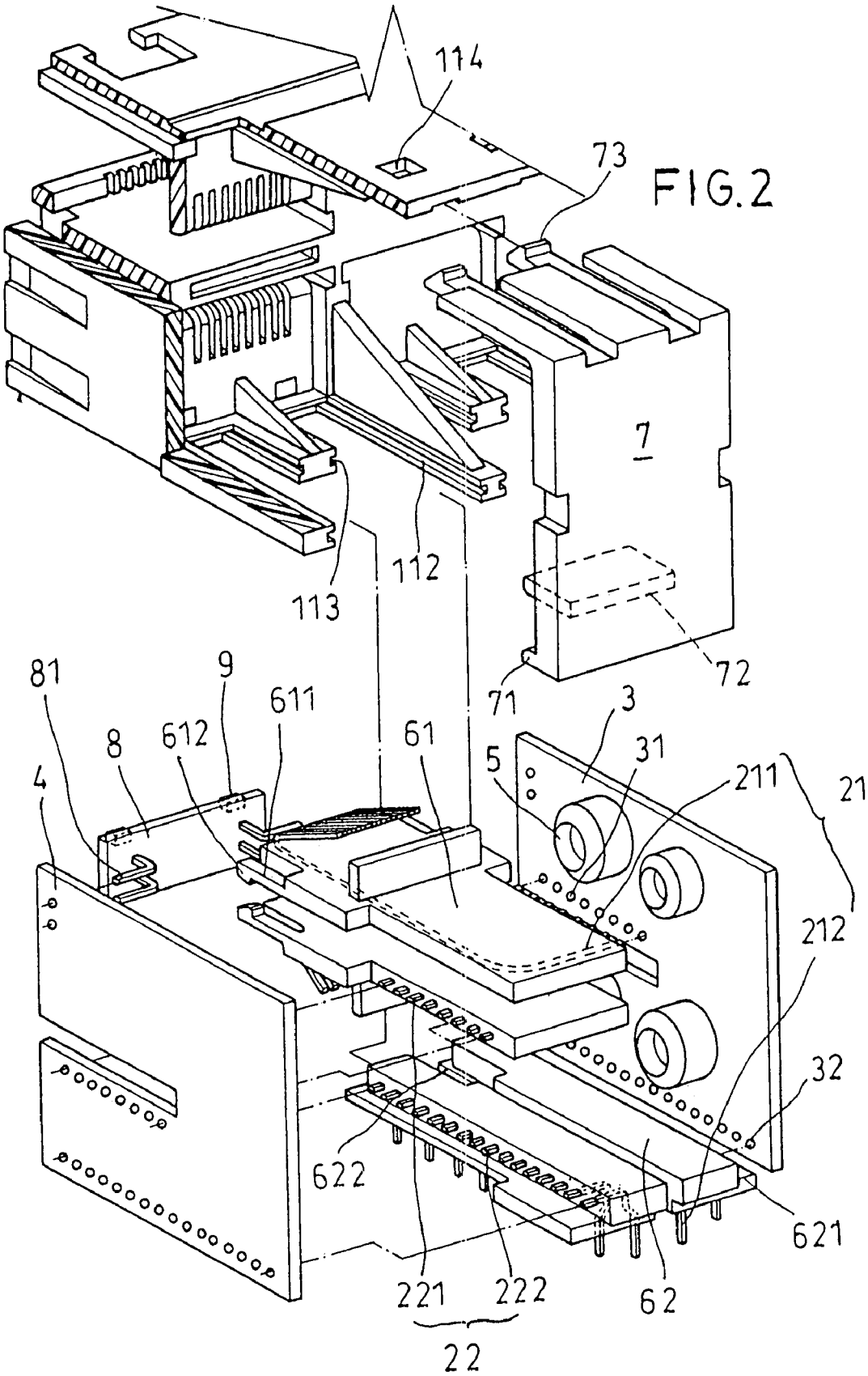
FIG. 2 is an exploded perspective view showing the multilayer electric connector with the upper and the lower conductive sets being separate.
Figure 3:
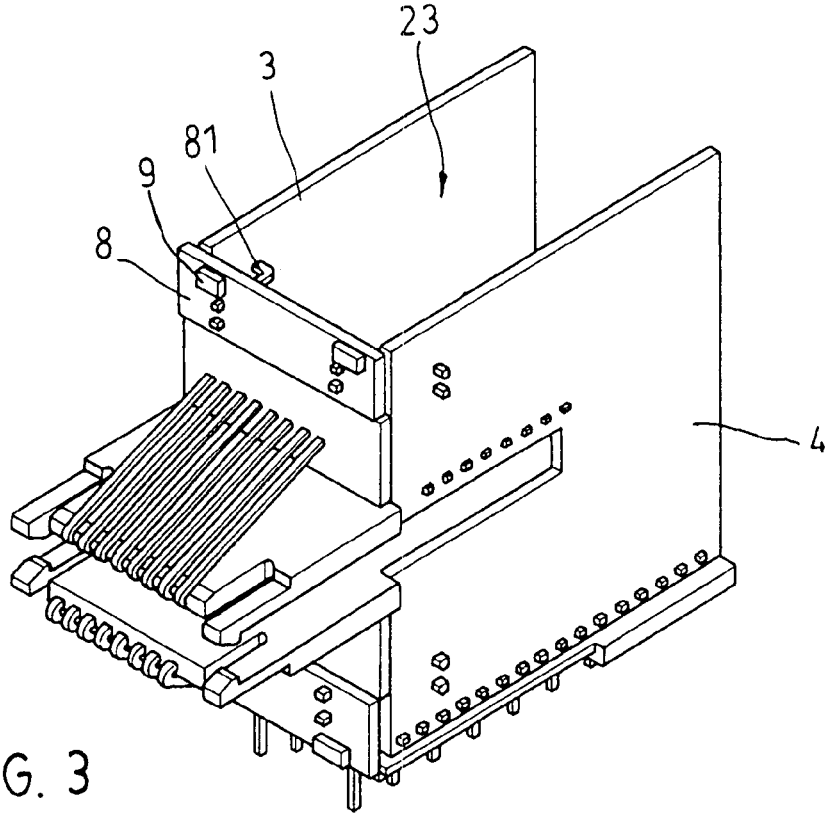
FIG. 3 is a perspective view of the multilayer electric connector in which the upper and the lower conductive sets are attached.
Figure 4:
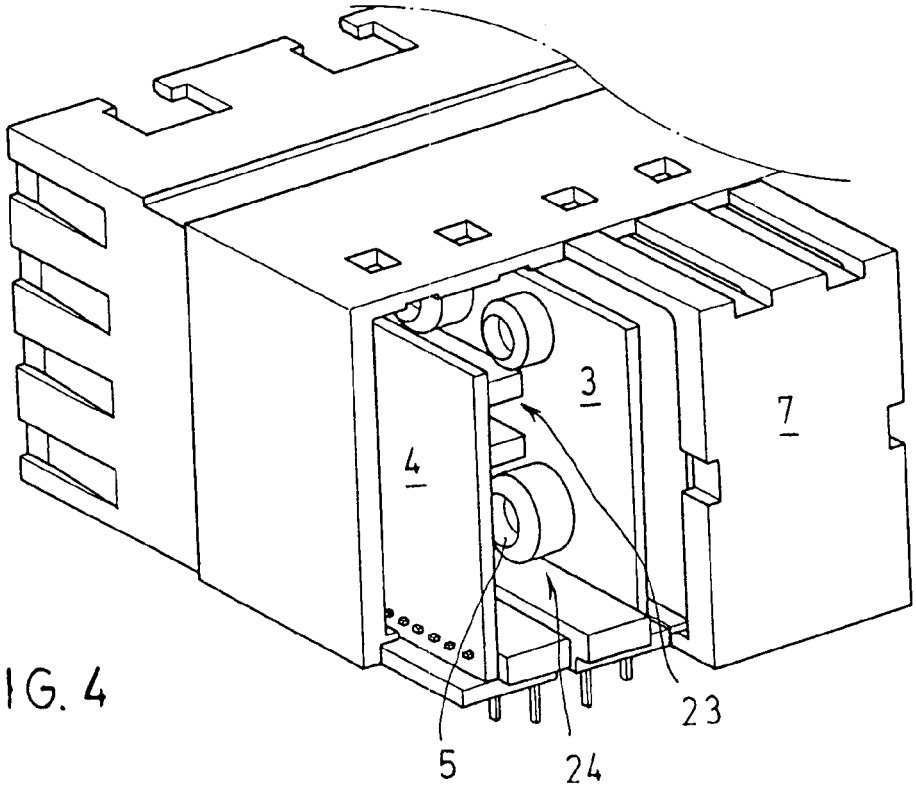
FIG. 4 is another perspective view f the multilayer electric connector in which the upper and the lower conductive sets are attached.

As shown in FIGS. 2, 3 and 4, the multilayer electric connector further includes a plurality of conductive sets each to couple with a respective upper slot 11 and a respect lower slot 12. In this present invention having two layers of slots, the conductive sets are categorized into upper conductive sets and lower conductive sets. Each of an upper conductive set 21 and a lower conductive set 22 has a first conductive member (211, 221) and a second conductive member (212, 222). The first conductive member 211 of the upper conductive set 21 has one terminal for electrically connecting to the main board 1 via the upper slot 11 and another terminal turning to a right circuit board 3 and for electric connection to the right circuit board 3 on a first predetermined location 31 thereon. The second conductive member 212 has one terminal for electrically connecting to the right circuit board 3 on a second predetermined location 32 thereon and another terminal turning to an external instrument terminal (not shown in the figures) and for electric connection to the external instrument terminal on a predetermined location thereon. The lower conductive set 22 is for electrically connecting the lower slot 22 and a left circuit board 4 in a symmetric configuration as the upper conductive set 21 connecting the upper slot 11 and the right circuit board 3. By the designated circuit layouts on the right circuit board 3 and the left circuit board 4, the upper conductive set 21 and the lower conductive set 22 can become electrically conductive so as to transmit signals from an external connector to an instrument terminal that connects to a circuit therein.

The first circuit board 3 and the second circuit board 4 are respectively erected on two opposite lateral sides of the upper conductive set 21 and the lower conductive set 22 to form a first receptacle 23 and a second receptacle 24. As shown in FIG. 4, the first receptacle 23 and the second receptacle 24 can house the electronic elements 5 of the right circuit board 3 and the left circuit board 4. The electronic elements 5 can provide a filtering mechanism that maintains the quality of the signals being transmitted by the multilayer electric connector. Since the space provided by the first receptacle 23 and the second receptacle 24 are substantial, the layout of the circuit boards 3, 4 are more flexible and the heat radiation of the elements 5 is more effective.

Figure 5:
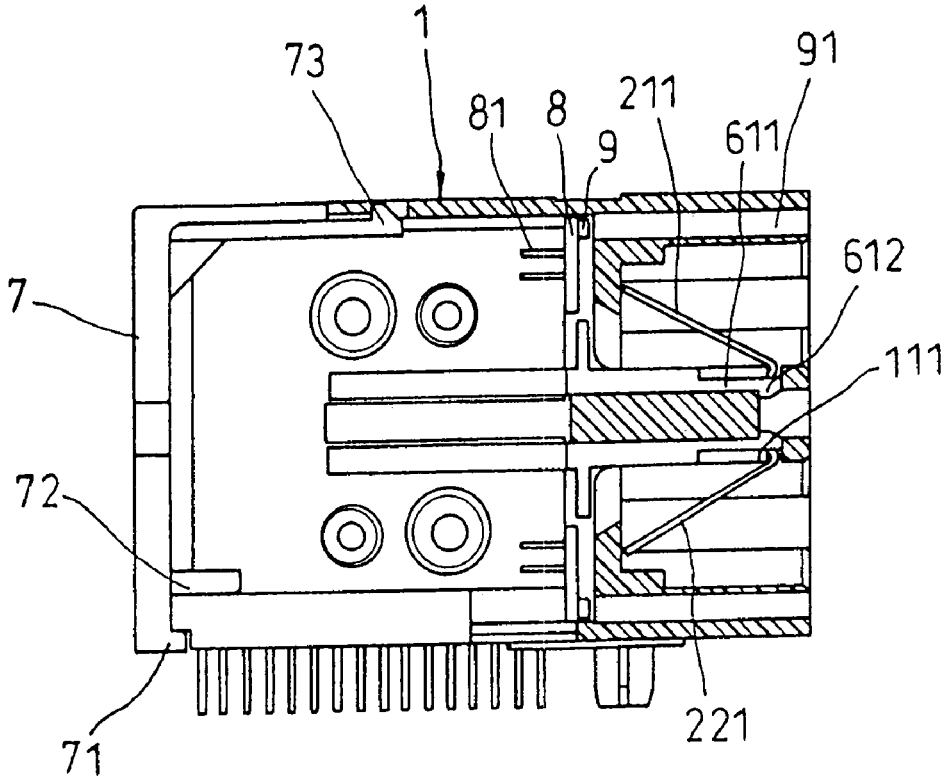
FIG. 5 is a cross-sectional view of the multilayer electric connector in which the upper and the lower conductive sets are attached.

To facilitate the assembly and to secure electric insulation, the upper conductive set 21 of the multilayer electric connector has its first conductive member 211 and the second conductive member 212 to be coated by insulting glue to form an upper retaining wall 61 and a lower retaining wall 62. Two lateral sides of a front end of the upper retaining wall 61 are each provided with an elastic level 611, and each elastic level 611 has one end fixed at the front end of the upper retaining wall 61 and a free end that includes a hook member 612. The hook members 612 are capable of being engaged with two indentations 111 after being inserted into the upper slot 11, as shown in FIG. 5.

To further secure the insertion of the retaining walls into the slots, two lateral sides of the lower retaining wall 62 are respectively provided with tracks 621 and 622 that can be respectively slidably coupled with grooves 112 and 113 on the main board 1, for guiding the lower retaining wall 62 into a locked position with main board 1. The rear ends of the upper retaining wall 61 and the lower retaining wall 62 are sealed with a cover 7 to prevent the retaining walls 61, 62 sliding backward after being locked on the main board 1. The cover 7 is connected to the main board 1 by coupling a hook member 73 on a top lateral face thereof with an indentation 114 on a selective location on the main board 1. The bottom lateral face of the cover 7 is further provided with an inwardly extending portion 71 for supporting a rear end of the lower retaining wall 62. The cover 7 is further provided with a pressing plate 72 corresponding to a top face of the lower retaining wall 62 for preventing the lower retaining wall 62 from shaking.

As shown in FIG. 3, a middle circuit board 8 including a light emitting device 9, LED for example, is deposited between the right circuit board 3 and the left circuit board 4 for electrically connecting the right and left circuit boards using a predetermined circuit thereon. The middle circuit board 8 can also be electrically connected to the right and left circuit boards 3 and 4 using external means selected from connecting pins or wires. Since the space between the right circuit board 3 and the left circuit board 4 is relatively large in the present invention, the middle circuit board 8 can further include other elements, such as a resistor, to protect the light emitting device 9 from burning out. This is an improvement from the multilayer electric connector disclosed in R.O.C. Pat. No. 510604, wherein the corresponding LED is fixed. To show the state of signal transmission, a light guide 91 deposited in the upper slot 11 can guide the light from light emitting device 9 out of the electric connector.

The middle circuit board 8 has hooks 81 for hooking the middle circuit board 8 to the second circuit board 4.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A multilayer electric connector comprising:

a main board having at least an upper slot and a lower slot;

a right circuit board for the at least one upper slot and the at least one lower slot;

a left circuit board for the at least one upper slot and the at least one lower slot;

an upper conductive set for electrically connecting the upper slot and the right circuit board, the upper conductive set consisting of a first conductive member and a second conductive member, the first conductive member having one terminal for electric connection to the main board via the upper slot and one other terminal turning to the right circuit board and for electric connection to the right circuit board on a first predetermined location thereon, the second conductive member having one terminal for electric connection to the right circuit board on a second predetermined location thereon and one other terminal turning to an external instrument terminal for electric connection to the external instrument terminal on a predetermined location thereon; and a lower conductive set for electrically connecting the lower slot and the left circuit board in a symmetric configuration as the upper conductive set connecting the upper slot and the right circuit board;

whereby a first circuit board and a second circuit board being respectively erected on two opposite lateral sides of the upper conductive set and the lower conductive set to form a first receptacle and a second receptacle for housing electronic elements that enhance signal quality by filtering or converting;

wherein the first conductive member and the second conductive member of the upper conductive set are coated by insulating glue to form an upper retaining wall and a lower retaining wall and wherein two lateral sides of a front end of the upper retaining wall are each provided with an elastic lever, each elastic lever having one end fixed at the front end of the upper retaining wall and a free end that includes a hook member, the hook members being capable of being engaged with two indentations on two predetermined locations within the upper slot as the upper retaining wall is inserted therein.

2. The multilayer electric connector of claim 1, wherein two lateral sides of the upper retaining wall and the lower retaining wall are each provided with a track that can be slidably coupled with a groove on the main board for guiding the upper retaining wall and the lower retaining wall into a locked position with main board.

3. The multilayer electric connector of claim 1, wherein rear ends of the upper retaining wall and the lower retaining wall are sealed with a cover to prevent the retaining walls sliding backward after being locked on the main board, the cover being connected to the main board by coupling a hook member on a top lateral face thereof with an indentation on a selective location on the main board, a bottom lateral face of the cover being provided with an inwardly extending portion for supporting a rear end of the lower retaining wall, the cover being further provided with a pressing plate corresponding to a top face of the lower retaining wall for preventing the lower retaining wall from shaking.

* * * * *